US007896280B2

(12) United States Patent
Barea

(10) Patent No.: US 7,896,280 B2
(45) **Date of Patent: *Mar. 1, 2011**

(54) METHOD AND DEVICE FOR THE CONSTANT-TENSION FEED AND TAKE-UP OF A YARN FED TO A TEXTILE MACHINE

(76) Inventor: Tiziano Barea, Busto Arsizio, Varese (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/691,963

(22) Filed: Jan. 22, 2010

(65) Prior Publication Data

US 2010/0116923 A1 May 13, 2010

Related U.S. Application Data

(62) Division of application No. 10/508,411, filed as application No. PCT/EP03/03258 on Mar. 28, 2003, now Pat. No. 7,699,258.

(30) Foreign Application Priority Data

May 3, 2002 (IT) ..... MI02A0945

(51) Int. Cl.
*B65H 59/18* (2006.01)

(52) U.S. Cl. ..... 242/365.7; 242/418.1; 242/419.8

(58) Field of Classification Search ..... 242/365.7, 242/418, 418.1, 419, 419.1, 419.8, 912; 226/11, 226/42, 43, 100, 143
See application file for complete search history.

(56) References Cited

U.S. PATENT DOCUMENTS 3,944,166 A * 3/1976 Hermanns ..... 242/147 A
4,673,139 A 6/1987 Memminger et al.
5,103,876 A 4/1992 Benz et al.
6,079,656 A 6/2000 Schmodde et al.
7,699,258 B2 * 4/2010 Barea ..... 242/365.7

FOREIGN PATENT DOCUMENTS

| | | |
|---|---|---|
| EP | 950 742 | 10/1999 |
| FR | 2 300 734 | 9/1976 |
| GB | 2 162 971 | 2/1986 |

OTHER PUBLICATIONS

Definitions of Venturi. http://www .google.com/search?sourceid=navclient&ie=UTF-8&rls=GGLD, GGLD:2004-30,GGLD:en&q=define%3AVenturi.

* cited by examiner

*Primary Examiner*—Michael R Mansen
*Assistant Examiner*—William E Dondero
(74) *Attorney, Agent, or Firm*—Young & Thompson

(57) ABSTRACT

A device for controlling the feed of a yarn to a textile machine operating intermittently on the yarn, there being provided elements to sense the tension of the yarn and elements for measuring and modifying its feed speed, all connected to control and regulator elements for the tension and speed parameters, which continuously measure the values of both parameters during the feed of the yarn to the textile machine so as to act on a rotary member in order to modify the tension of the yarn when necessary. The rotary member is movable in a controlled manner in the two opposing directions of rotation to feed the yarn to the textile machine or to rewind it in order to prevent its accumulation in correspondence with the machine, the tension of the yarn fed or rewound being maintained at constant values.

23 Claims, 3 Drawing Sheets

METHOD AND DEVICE FOR THE CONSTANT-TENSION FEED AND TAKE-UP OF A YARN FED TO A TEXTILE MACHINE

This application is a division of co-pending application Ser. No. 10/508,411 filed on May 13, 2005, which is the 35 U.S.C. §371 national stage of International PCT/EP03/03258 filed on Mar. 28, 2003, which claims priority to Italian Application No. MI02A000945 filed on May 3, 2002. The entire contents of each of the above-identified applications are hereby incorporated by reference. Any disclaimer that may have occurred during prosecution of the above referenced applications is hereby expressly disclaimed.

The present invention relates to a device for feeding a yarn to a textile machine operating in an intermittent manner on the yarn, i.e. of the type in which the yarn is used for successive periods of time interrupted by periods of time in which the yarn is not used by said machine, said feed taking place at constant tension, the device being of the type indicated in the introduction to the main claim.

The invention also relates to a yarn control method implemented by the aforesaid device.

Devices for controlling a yarn fed at constant tension to a textile machine have been known for some time. Generally, these devices are composed of a yarn tension sensor connected to a measurement and processing circuit able to control on a closed-loop basis an electric motor (for example a stepping or brushless motor) arranged to act, by braking or acceleration, on a roller or pulley operating directly on the yarn, in order to feed it under constant tension conditions. The sensor is usually positioned between the textile machine and said pulley, the speed of rotation of which is increased or decreased on the basis of the comparison between the measured tension and a reference value.

Such a device is known for example from EP950742.

The said constant tension feed devices (or CTDs) are currently widely used, in particular for controlling yarn to textile machines of small-diameter circular type for the production of tights, or to medium-diameter machines, known as "body size", for producing knitted underwear. There are however many other applications in which said devices could be used with considerable advantage in terms of efficiency and knitting quality of the article produced, for example machines for men's socks, or for medical stockings, large-diameter circular machines with ribbing devices, straight-bar knitting machines, cotton looms or machines with automatic thread guide change. Any lack of use of known devices of the aforesaid type is related to the method of operation of such machines which act intermittently on the yarn: the yarn is withdrawn (from a bobbin or the like) and used to produce a part of the article; the withdrawal is then suspended to enable production of the article to continue with another yarn and is then recommenced to continue production of said part of the article (for example a pattern on a jumper).

By way of example, stocking machines or those for producing men's socks or medical stockings, are normally able to operate with intermittent movement for producing the pocket necessary for making the toe and heel of the article. During the production of the knitted tube for the leg, these machines operate by rotating a cylindrical member, for example continuously in the anticlockwise direction, to form the knitwork on it by suitable yarn pick-up members specific for this purpose such as needles and sinkers, whereas in contrast during the heel and toe formation, these machines operate with a so-called intermittent movement. During this operation the yarn fed to the textile machine is seized by said pick-up members and then released as a result of the intermittent motion necessary for forming the relevant part of the knitwear, for example the heel. In order to take up said yarn during its release and to prevent it from accumulating in the machine, such machines are equipped with known mechanical and/or pneumatic take-up members normally in the form of flexible arms acting on the yarn and connected to suitable take-up springs.

Similar take-up methods are used by straight-bar knitting machines which, as is known, have a carriage which travels along a linear surface on which the knitwork forming members or needles are positioned. This travel takes place in one direction for forming one row of knitting and in the opposite direction for forming the next row. The yarn to be controlled is fed during this reversal of the carriage which, in known manner, conveys the yarn feed guides. This control is again effected by mechanical, pneumatic and/or magnetic members, again operated by flexible arms acting on the yarn for take-up purposes.

Likewise, circular machines for ribbed knitting require small take-up armlets which normally also operate as electrical cut-outs if yarn is lacking. The purpose of these armlets is to control the change-over of the thread guide and to take up the yarn excess accumulated during this change-over and also any slackness if excessive, for example indicative of yarn breakage.

In the aforesaid machines there is also the problem of their non-stoppage when the yarn connected to the take-up armlets breaks, this non-stoppage being due to the accumulation of dust and yarn residues on the armlets which prevent their correct movement (because they do not undergo slackening). Moreover, as said take-up armlets cannot be finely regulated with regard to the force which they exert on the yarn, they are not able to ensure perfect take-up of the yarn controlled by them, in particular because of the high productive flexibility and type of yarn currently demanded.

Finally, said tension take-up devices are often unable to halt the textile machine if the yarn is not completely and totally absent, in that even in the case of a breakage downstream of the take-up device, the yarn if thick or hairy may remain in contact with the device so that there is no effect (slackening) sufficient to enable the device to halt the textile machine.

Moreover, in such machines the known "constant-tension" yarn control devices are not used, neither can they used because their current construction and their mode of operation are such that in certain cases an error signal would be generated each time the yarn controlled by them stops running, this resulting in obvious inconvenience. In other cases, the known devices of the stated type would block to enable the yarn to accumulate or slacken at the machine, requiring the presence of mechanical members or its take-up; if this take-up were not effected, unacceptable working problems would result.

An object of the present invention is to provide a device for constant-tension yarn control which can also be used in those textile machines which operate intermittently on the yarn.

A particular object of the present invention is to provide a device able to feed to a textile machine of the stated type a yarn at programmable constant tension and able to automatically take up this yarn again at programmable constant tension, so as to increase the quality of the article by eliminating the known interference due to sudden tension variations as the yarn unwinds from usual reels or bobbins, and to those gradual tension variations due to the natural emptying of such reels or bobbins.

Another object is to provide a device able to completely eliminate the usual yarn take-up members in said textile machines, with advantages in terms of cost reduction, textile machine simplification and increase in its efficiency.

A further object is to enable a yarn feed tension to be programmed which is different from the yarn take-up tension, to allow improved quality and precise control of this delicate operative state of such textile machines.

A further object is to provide a device able to take up the yarn at a programmable tension should it slacken, and to halt the textile machine only if the tension of this yarn falls below a determined programmable threshold for a time exceeding a determined value, which is also programmable.

These and further objects which will be apparent to the expert of the art are attained by a device in accordance with the accompanying claims.

The present invention will be more apparent from the accompanying drawing, which is provided by way of non-limiting example and in which.

Figure 1:
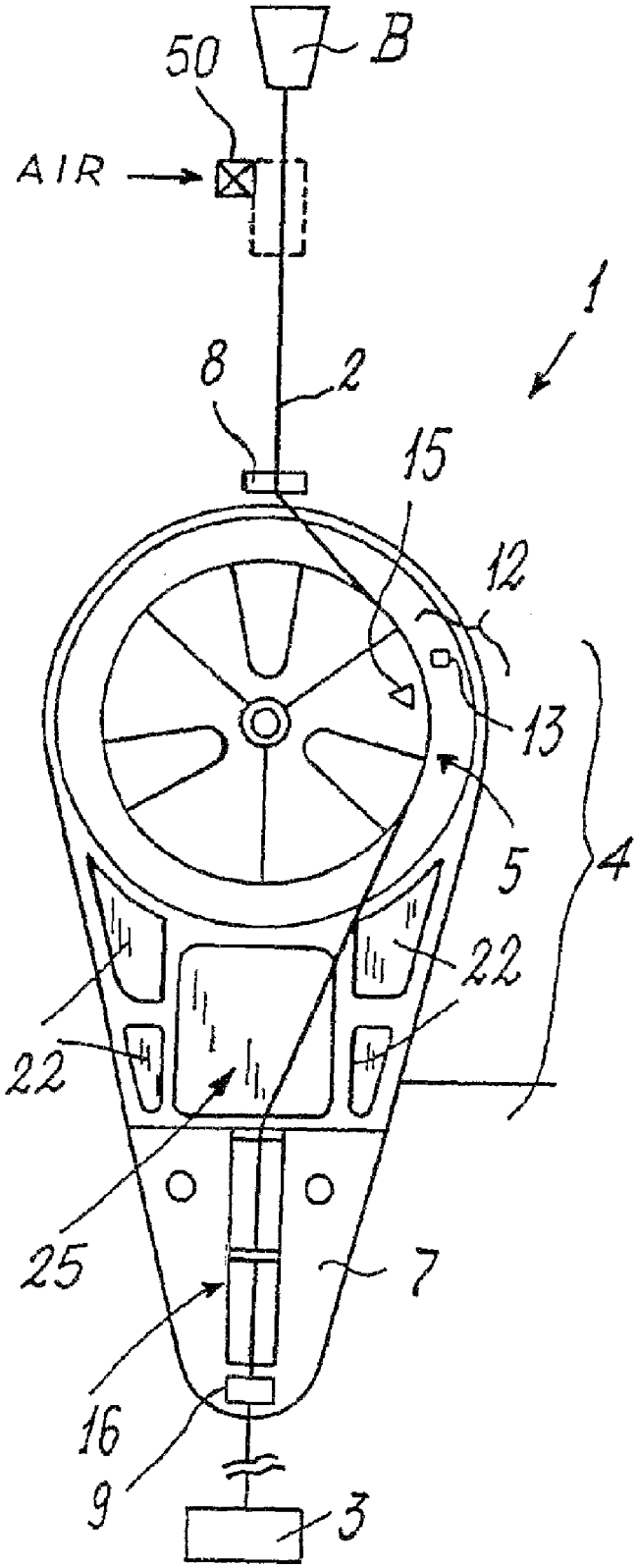
FIG. 1 is a front view of a device according to the invention.

With reference to FIG. 1, this shows a device 1 for feeding at "constant tension" a yarn 2 to a textile machine 3 of the type operating with intermittent motion (in the aforedefined sense) on the yarn 2. This device comprises a body 4 (for example box-like). With this body there is associated a grooved wheel or pulley 5 driven by an actuator (not shown). This actuator can be an electric motor (for example of stepping or brushless type) associated with that face of the body 4 opposite the face 7 on which the pulley 5 is present. Such a device 1 cooperates with each yarn 2 fed to the machine, said yarn unwinding from a bobbin B and winding one or more times about the pulley 5 (or being simply in contact therewith).

The yarn cooperates with yarn guide bushes 8 and 9 which guide it respectively about the pulley 5 (or yarn feed spool) and towards the textile machine 3.

The pulley is directly or indirectly connected to a member 12 which measures its rotation and hence the speed of this rotation. This member can be a magnetic sensor 13 associated with the body 2 and cooperating with a magnet 15 associated with the pulley or a known Hall sensor associated with the motor (for example a brushless motor with a Hall sensor incorporated) which provides the movement of the pulley 3.

The body 2 also supports a member 16 for measuring the tension of the yarn 2 directed to the machine 3; this member is of known type and can comprise a usual magnetic sensor, a piezoelectric sensor, a load cell, an elastically supported armlet or another known sensor.

The tension sensing member 16, the measurement member 12 for the rotational speed of the pulley and the motor connected to this latter are connected to a unit (not shown) for controlling and regulating the feed of the yarn 2 to the textile machine 3. Advantageously, this control unit (advantageously a microprocessor) is associated with the device 1 (inserted into its body 4) and is able, via the connection to said measurement members, to measure correctly and precisely the quantity of yarn (in meters per minute) fed to the machine, using evaluation algorithms which consider both the measured tension of the yarn 2 and the speed of rotation of the pulley.

To the control unit there are connected usual setting members associated with the body 4; these members are for example an interface keypad 22 present on the face 7 of the body 4. On this face there is also advantageously present a display 25 on which the control unit displays the data measured by it, such as the yarn feed speed, the quantity of yarn fed to the textile machine 3, its tension and other data related to the yarn or to the unit itself (programmed tension and other functions programmable by the unit, alarms, etc.).

According to the invention, the device 1 is used to feed at constant tension "T" a yarn which moves with intermittent movement towards and away from the textile machine 3 on the basis of predetermined operative steps thereof. Specifically, the device 1 feeds the yarn at (predetermined) constant tension T while it is being drawn in by the machine 3, and when this latter stops drawing the yarn as determined by the particular process on the article underway, the device 1 draws the yarn from the machine by take-up, again at constant tension (which during yarn take-up is indicated by R) but which can be different from the feed tension T. Both the tension R and the tension T can be programmed, for example on the basis of the type of yarn (natural or synthetic) which is used, its elasticity, etc.

In order to operate in the aforedescribed manner, the pulley 5 can rotate in one direction of movement, namely that which enables the yarn 2 to be fed to the textile machine 3, as in the case of known constant tension yarn feed devices. Rotation in the two directions (clockwise or anticlockwise) is always effected under the command of the control unit by acting on the pulley actuator, on the basis of the value of the tension T or R measured continuously by the member 16.

Figure 2:
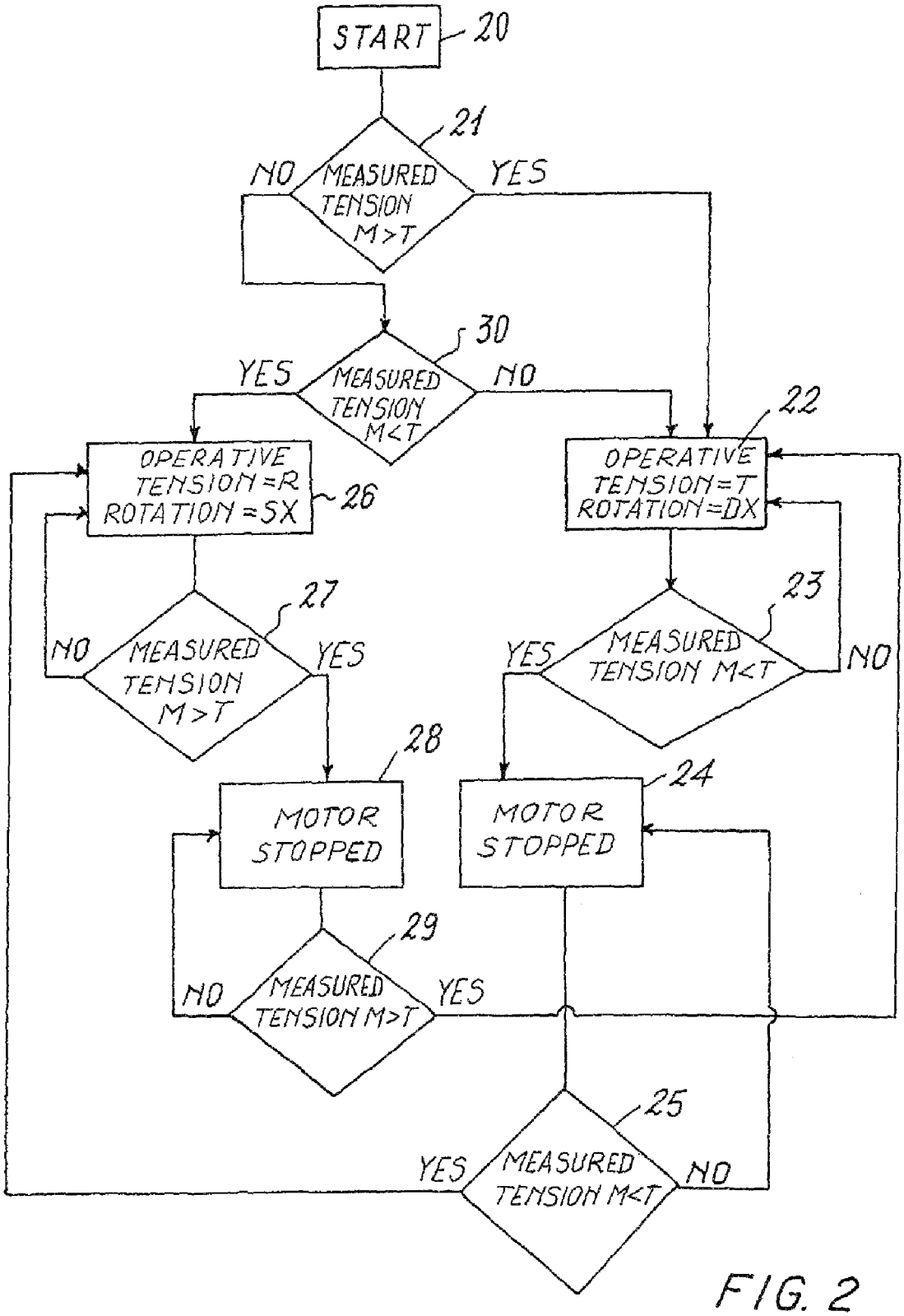
FIG. 2 is a block diagram of one embodiment of the method according to the invention during the determination of the direction of rotation of a part of the device of FIG. 1.

By analyzing the diagram of FIG. 2, it will now be possible to understand the method of the invention and the relative operation and operability of the device as described in relation to FIG. 1.

On starting (START block 20 of FIG. 2), the device 1 compares (block 21) the measured tension "M" with the set feed tension T. If the measured tension is greater (M>T), the device opts to adjust the tension and feed the yarn at the set value T, and hence rotates the actuator in the clockwise direction (block 22), with reference to FIG. 1. In this manner the quantity of yarn withdrawn from the bobbin 2 and fed to the textile machine 3 is increased, such as to decrease the value of the measured tension M until it equals the set tension T.

The device then continues to feed at constant tension T until the measured tension becomes less than the value T (M<T block 23): in that case the actuator acting on the pulley 5 decelerates this latter by braking it to maintain the set valve T. During this operation, the tension of the yarn 2 is continuously monitored, and if while braking the pulley 5 to achieve uniform tension the point is reached at which it halts (block 24) without having attained the desired tension, the control unit senses that the yarn tension is less than the set tension T and that the yarn has stopped, i.e. that the textile machine is carrying out an operation which does not require the use of the yarn 2 under control. In this case the control unit compares the measured tension with the take-up tension R (block 25).

If the result of this comparison shows that the measured tension "M" is less than the take-up tension "R" (M<R), the device begins to operate with the pulley 5 driven in the anticlockwise direction SX by the relative actuator, to obtain a yarn tension equal to the set take-up value R (block 26). The yarn is hence taken up and maintained at this tension value with continuous control of the tension M (block 27). The yarn is hence rewound on the pulley 5, which stops when the take-up tension R is attained.

When the textile machine 3 again requires the yarn 2, this is drawn towards the machine 3. At this point, the control unit again begins to measure the tension, comparing it with the predetermined tension value T and continuing this comparison until the measured value M exceeds the tension value T (block 29), at which point the operation begins again from block 22. During this initial comparison the pulley 5 is at rest.

When the measured tension value exceeds the reference value T, the system returns to feeding the yarn and maintaining its tension constant at the value T by again rotating the actuator in the clockwise direction DX while waiting for the yarn to again halt to reverse its running direction and again activate the yarn take-up function (M<R block 30).

Figure 3:
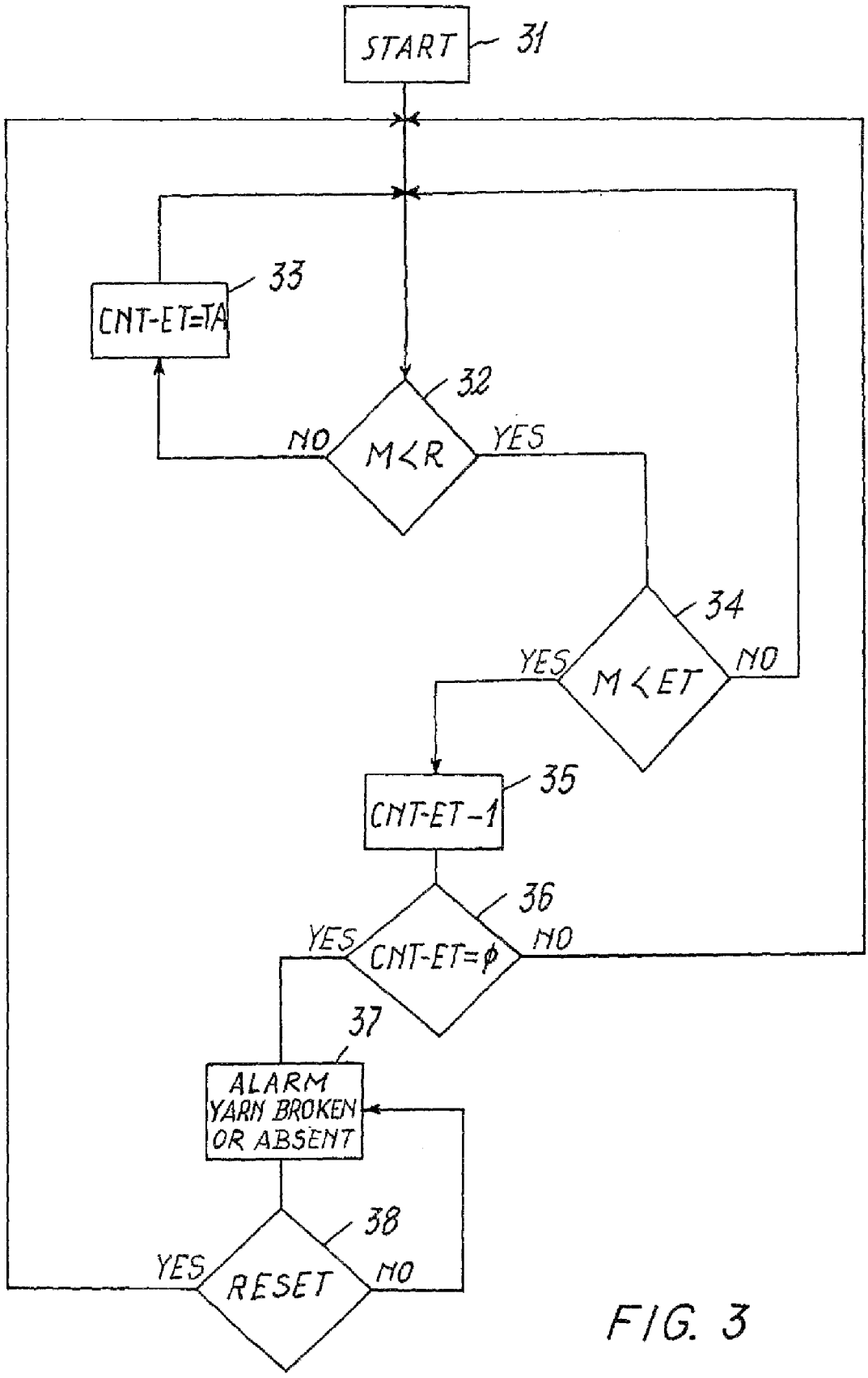
FIG. 3 is a flow diagram showing a stage in the method of the invention during the determination of the tension alarm condition resulting from the sensing of a broken or lacking yarn.

If the comparison of block 21 gives a negative result, the operation of the device 1 comprises comparing the measured tension M with the take-up tension R (block 30), from which the operation continues in accordance with the aforedescribed block 22 or block 26. In other words, the control unit measures the value of the current tension M via the sensing member 16 and compares it with one of the reference values R and T; on the basis of the result of this comparison, the control unit acts on the actuator of the pulley 5 in order to make the measured tension M equal to the reference tension R or T. If, following this comparison and action, the tension value changes, with a consequent attempt by the device 1 to compensate the tension via the corresponding step of varying the angular or rotational speed of the pulley 5, but resulting in stoppage of this latter, the control unit senses the change in the state of use of the yarn (for example from a state of traction by the bobbin to a state of stoppage) and causes the pulley 5 to rotate in the opposite direction. On rotation reversal, the unit carries out the same monitoring and possible modification of the measured yarn tension, until this tension adjustment again causes stoppage of the pulley. At this point the direction of rotation of the pulley is again changed in order to achieve the tension set for yarn feed to the textile machine or for take-up. With reference to FIG. 3, a description will now be given of the procedure used to activate the alarm denoting yarn broken or lacking. On starting (START, block 31 of FIG. 3), the device 1 makes a comparison (block 32) between the measured tension M and the programmed take-up tension R (M<R). If the measured tension is equal to or greater than the value R, a tension error counter CNT-ET is loaded with a value equal to a set alarm time TA (block 33). If however the measured value is less, a new comparison is made between the measured value M and the value equal to the set error tension ET (M<ET, block 34).

According to this latter comparison, if the measured value is not less than the set tension error ET, the system returns to the preceding comparison M<R. If however from the comparison M<ET, the measured value is found to be less, the alarm time counter is decremented to CNT-ET−1 (block 35) it then being verified whether this counter has reached 0 (block 36). If negative, the system again returns to the comparison M<R; if affirmative, the textile machine is halted in that at this point the yarn is broken or lacking (block 37). An alarm signal is also preferably generated.

After the stoppage of the textile machine, the system awaits automatic resetting or manual resetting by the operator (RESET block 38) responsible for restarting the textile machine, to re-launch the system at the initial comparison M<R. In a more complicated embodiment of the device of the invention, during take-up it could also be necessary to take up the yarn accumulated upstream of the feed device in proximity to the bush 2 of FIG. 1. In that case the device of the present invention could, in synchronism with said take-up stage, operate a solenoid valve 50 providing a blast of air at the mouth of a tube 51 of appropriate length, for example 20 cm, through which the yarn fed to the bush 2 transits. In this manner a venturi effect is created able to draw in and hence take up the excess yarn which could accumulate between said bush 2 and the pulley 5, so preventing the formation of groupings or knots which could cause the yarn to break. The solenoid valve 50 is controlled by the control unit of the device 1.

Other embodiments can be deduced from the aforegoing description and are to be considered as lying within the scope of the present invention.

What is claimed is:

1. A method for controlling the feed of a yarn to a textile machine, comprising:

feeding the yarn to the textile machine operating intermittently on said yarn (2) for successive discrete periods of time interrupted by periods in which the yarn is at rest and is not used, said feeding comprising i) measuring tension of the yarn (2) fed to the textile machine and unwound from a bobbin (B), ii) effecting an intervention, as a result of this measurement, on the yarn (2) to obtain a feed tension (T) that is a constant feed tension (T), and iii) with a yarn take-up device located upstream of a yarn feed regulator, providing an automatic take-up on the yarn each time the yarn is not withdrawn or is released by the textile machine (3), said take-up being effected in such a manner as to achieve constant yarn tension (R), said take-up of the yarn (2) being activated automatically when, after sensing a change in the tension of the yarn (2) and then intervening to maintain the feed tension (T) constant, a current measured tension value (M) is obtained which is less than a feed tension value (T), during take-up of the yarn (2) the yarn's take-up tension (R) being monitored and take-up being interrupted when the take-up tension reaches a predetermined value.

2. The method as claimed in claim 1, wherein said measuring step comprises measuring a current tension (M) and comparing the measured current tension (M) with a reference tension value (T, R) corresponding to a stage during which the yarn (2) is fed to the textile machine (3) or to a stage in which said yarn is unused then, on the basis of the result of this comparison, said effecting an intervention step is performed on the yarn in order to make the measured tension (M) equal to the reference tension (T, R).

3. The method as claimed in claim 1, wherein the intervention for correcting the tension in the yarn (2) is obtained by operating and controlling a rotary member (5) with which the yarn (2) is in contact or on which the yarn is wound for at least one turn, said member being rotated in one direction or in the opposite direction on the basis of the value of the measured tension (M) and a comparison of the measured tension (M) with the reference tension (T, R).

4. The method as claimed in claim 3, wherein the take-up of the yarn (2) commences when, with yarn having previously been fed to the textile machine (3), the rotary member (5) stops moving following at least one attempt to make the measured tension (M) equal a predetermined value (T).

5. The method as claimed in claim 4, wherein after stoppage of the rotary member (5) while moving in one direction, the rotary member is moved in the opposite direction until the measured tension (M) of the yarn (2) reaches a predetermined value (R).

6. The method as claimed in claim 1, wherein the tension (T) of the yarn fed to the textile machine (3) and the tension (R) of the yarn (2) taken up at rest are different.

7. The method as claimed in claim 1, wherein the tension (T) of the yarn fed to the textile machine (3) and the tension (R) of the yarn (2) taken up at rest are equal.

8. The method as claimed in claim 1, wherein, in comparing the value of the current tension (M) with the value of the take-up tension (R), the value of the current tension (M) is less than the value of the take-up tension (R) and the value of the current tension (M) remains less than the value of the take-up tension (R) for a predetermined number of comparisons, an alarm signal is generated to indicate the lack of yarn (2) fed to the textile machine (9).

9. The method as claimed in claim 8, wherein upon the comparison between the value of the current tension (M) in the yarn (2) and the value of the take-up tension (R) shows that the value of the current tension (M) is less than the value of the take-up tension (R), the current tension is compared with an acceptable tension error value (ET).

10. The method as claimed in claim 9, wherein upon the comparison between the value of the current tension (M) and the acceptable tension error value (ET) shows that the value of the current tension (M) is less than the value of the acceptable tension error value (ET), an error counter is decremented, and when the error counter reaches zero the alarm signal is generated.

11. The method as claimed in claim 1, comprising the further steps of:

measuring the yarn speed; and following said feeding step, directing the yarn in a direction of a bobbin (B) from which bobbin the yarn unwinds.

12. A device for controlling the feed of a yarn to a textile machine operating intermittently on said yarn (2) for successive discrete periods of time interrupted by periods in which the yarn is at rest and is not used for the production of an article, the yarn being feed to the textile machine at an intrinsic speed, said device comprising:

a yarn feed regulator (5);

a tension sensor (16) configured to sense the tension of the yarn;

a control and regulator continuously measuring said tension during the feed of the yarn (2) to the textile machine (3) so as to act on the yarn feed regulator (5) in order to modify the tension of the yarn (2) when necessary, said yarn feed regulator (5) and said tension sensor (16) connected to said control and regulator, said yarn feed regulator being a rotary member (5) being in contact with, or about which there winds at least for one turn, the yarn (2) directed to the textile machine; and a yarn take-up device located upstream of the rotary member (5), said rotary member (5) being driven by an actuator controlled by the control and regulator, said rotary member (5) being movable in a controlled manner in two opposing directions of rotation, a first movement in the first direction of rotation taking place when the yarn (2) is fed to the textile machine, and a second movement in the second direction of rotation taking place during at least one of i) the yarn (2) being at rest, and ii) the yarn being driven from the textile machine towards a bobbin, in said second movement the yarn (2) being drawn and wound onto the rotary member (5) to prevent the yarn's accumulation in correspondence with the textile machine (3), wherein the yarn tension is maintained at constant values (T, R) both during feed to the textile machine and during each period in which the yarn taken up is at rest or rewound onto the rotary member (5).

13. The device as claimed in claim 12, wherein the device is configured for controlling the feed of a yarn, where the yarn stoppage is followed by returning the yarn in a direction of the bobbin (B) from which bobbin the yarn is withdrawn, and wherein the tension (T) of the yarn fed to the textile machine (3) and the tension (R) of the yarn (2) taken up at rest are equal.

14. The device as claimed in claim 13, wherein the rotary member is one of a wheel and a pulley.

15. The device as claimed in claim 12, wherein the tension (T) of the yarn fed to the textile machine (3) and the tension (R) of the yarn (2) taken up at rest are equal.

16. The device as claimed in claim 12, wherein the actuator is one of a general electric motor, a stepping electric motor, and a brushless electric motor.

17. The device as claimed in claim 12, wherein the tension sensor (16), the rotary member (5), and the control and regulator are associated with a single support defining the body (4) of the device.

18. The device as claimed in claim 12, further comprising an interface (22) for setting the yarn feed tension (T) and the yarn take-up tension (R).

19. The device as claimed in claim 12, wherein the yarn take-up device is a suction device.

20. The device as claimed in claim 12, wherein the take-up device comprises a venturi tube through which the yarn passes and to which air is fed for sucking the yarn therethrough.

21. The device as claimed in claim 12, wherein the yarn feed regulator (5) also measure the yarn speed.

22. A method of operating a combination of the device of claim 12 and a textile machine, wherein the device controls the feed of yarn to the textile machine by:

feeding the yarn to the textile machine operating intermittently on said yarn (2) for successive discrete periods of time interrupted by periods in which the yarn is at rest and is not used, said feeding comprising i) measuring tension of the yarn (2) fed to the textile machine and unwound from a bobbin (B), ii) effecting an intervention, as a result of this measurement, on the yarn (2) to obtain a constant feed tension (T), and iii) providing an automatic take-up on the yarn each time the yarn is not withdrawn or is released by the textile machine (3), said take-up being effected in such a manner as to achieve constant yarn tension (R), said take-up of the yarn (2) being activated automatically when, after sensing a change in the tension of the yarn (2) and then intervening to maintain the feed tension (T) constant, a current measured tension value (M) is obtained which is less than the feed tension value (T), during take-up of the yarn (2) the yarn's take-up tension (R) being monitored and take-up being interrupted when the take-up tension reaches a predetermined value.

23. The method of operating the combination of claim 22, wherein the textile machine is one of i) a machine for manufacture of men's socks or medical stockings, ii) a large-diameter circular machine with ribbing devices, iii) a straight-bar knitting machine, iv) a cotton loom, and v) a machine with an automatic thread guide change.

* * * * *